US011618620B2

(12) United States Patent
Robinson, II

(10) Patent No.: US 11,618,620 B2
(45) **Date of Patent: *Apr. 4, 2023**

(54) CAP PROTECTOR

(71) Applicant: L'Oreal, Paris (FR)

(72) Inventor: Michael P. Robinson, II, Brooklyn, NY (US)

(73) Assignee: L'Oreal, Paris (FR)

( * ) Notice: Subject to any disclaimer, the term of this patent is extended or adjusted under 35 U.S.C. 154(b) by 247 days.

This patent is subject to a terminal disclaimer.

(21) Appl. No.: 16/921,517

(22) Filed: Jul. 6, 2020

(65) Prior Publication Data

US 2020/0331669 A1 Oct. 22, 2020

Related U.S. Application Data

(63) Continuation of application No. 15/965,646, filed on Apr. 27, 2018, now Pat. No. 10,703,546.

(51) Int. Cl.

| | |
|---|---|
| ***B65D 51/18*** | (2006.01) |
| ***B65D 41/62*** | (2006.01) |
| ***B65D 45/16*** | (2006.01) |
| ***B65D 45/24*** | (2006.01) |

(52) U.S. Cl.

CPC ..... *B65D 51/18* (2013.01); *B65D 41/62* (2013.01); *B65D 45/16* (2013.01); *B65D 45/24* (2013.01)

(58) Field of Classification Search

CPC ..... B65D 51/18; B65D 41/62; B65D 45/16; B65D 45/24; B65D 81/02

See application file for complete search history.

(56) References Cited

U.S. PATENT DOCUMENTS

| | | | | |
|---|---|---|---|---|
| 809,213 | A | 1/1906 | Osgood | |
| 811,824 | A | 2/1906 | Clay | |
| 1,002,963 | A | 9/1911 | Bostwick | |
| 1,574,458 | A | 2/1926 | Wendel | |
| 2,021,084 | A | 11/1935 | Nutter | |
| 3,774,798 | A | 11/1973 | Andrade et al. | |
| 4,230,230 | A | 10/1980 | Mumford | |
| 4,368,840 | A | 1/1983 | Pardo | |
| 4,540,099 | A | 9/1985 | Swartzbaugh et al. | |
| 4,544,073 | A | 10/1985 | Willis | |
| 4,742,929 | A * | 5/1988 | Desai | B65D 41/04 215/332 |
| 4,776,476 | A | 10/1988 | Simard | |
| 2006/0086688 | A1 * | 4/2006 | Tang-Lee | B65D 41/04 215/44 |

(Continued)

FOREIGN PATENT DOCUMENTS

| | | |
|---|---|---|
| CN | 202642393 U | 1/2013 |
| RU | 74371 U1 | 6/2008 |

*Primary Examiner* — James N Smalley

(74) *Attorney, Agent, or Firm* — Christensen O'Connor Johnson Kindness PLLC

(57) ABSTRACT

A cap protector for protecting a cap on a container includes a plurality of axial fins extending from a common point. Each axial fin includes a body extending between an inner edge and an outer edge, and a cap-engaging lip defined on the inner edge that is configured to selectively engage a cap of a container. The plurality of axial fins may be movable from a disengaged position to an engaged position, wherein in the engaged position the cap-engaging lip of each of the plurality of axial fins engages the cap of a container.

13 Claims, 5 Drawing Sheets

(56) References Cited

U.S. PATENT DOCUMENTS

| | | | | |
|---|---|---|---|---|
| 2007/0148400 | A1 | 6/2007 | Sattora et al. | |
| 2010/0140431 | A1 | 6/2010 | Van Horne | |
| 2017/0015476 | A1* | 1/2017 | McClellan ..... | A61J 1/065 |

* cited by examiner

CAP PROTECTOR

CROSS REFERENCE TO RELATED APPLICATION

This application claims priority to and is a continuation of copending U.S. patent application Ser. No. 15/965,646, filed Apr. 27, 2018, the entirety of which is hereby incorporated by reference in its entirety for all purposes.

SUMMARY

A cap protector for protecting a cap on a container includes a plurality of axial fins extending from a common point. Each axial fin includes a body extending between an inner edge and an outer edge, and a cap-engaging lip defined on the inner edge that is configured to selectively engage a cap of a container. The plurality of axial fins may be movable from a disengaged position to an engaged position, wherein in the engaged position the cap-engaging lip of each of the plurality of axial fins engages the cap of a container.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION

Protective packaging is used to protect products that are susceptible to damage during shipping. For instance, the product(s) may be surrounded by air pillows, Styrofoam sheets, loose form fill, newspaper, form blocks, etc. However, certain shipped products cannot be easily or affordably protected by such protective packaging. For instance, a capped glass or plastic container (such as a water bottle, a soda bottle, a medicine bottle, a condiment bottle, etc.) may not include protective packaging around the upper end of the bottle where the cap is attached to the container body. Accordingly, the cap may become damaged, loose, or separated from the container body during transit, and/or the upper end of the container body may become damaged.

A cap protector 20 formed in accordance with an exemplary embodiment of the present disclosure is shown in FIGS. 1-5. The cap protector 20 is generally configured to protect an upper end of a capped container during shipping, processing, or other potential damaging activities.

Figure 1:
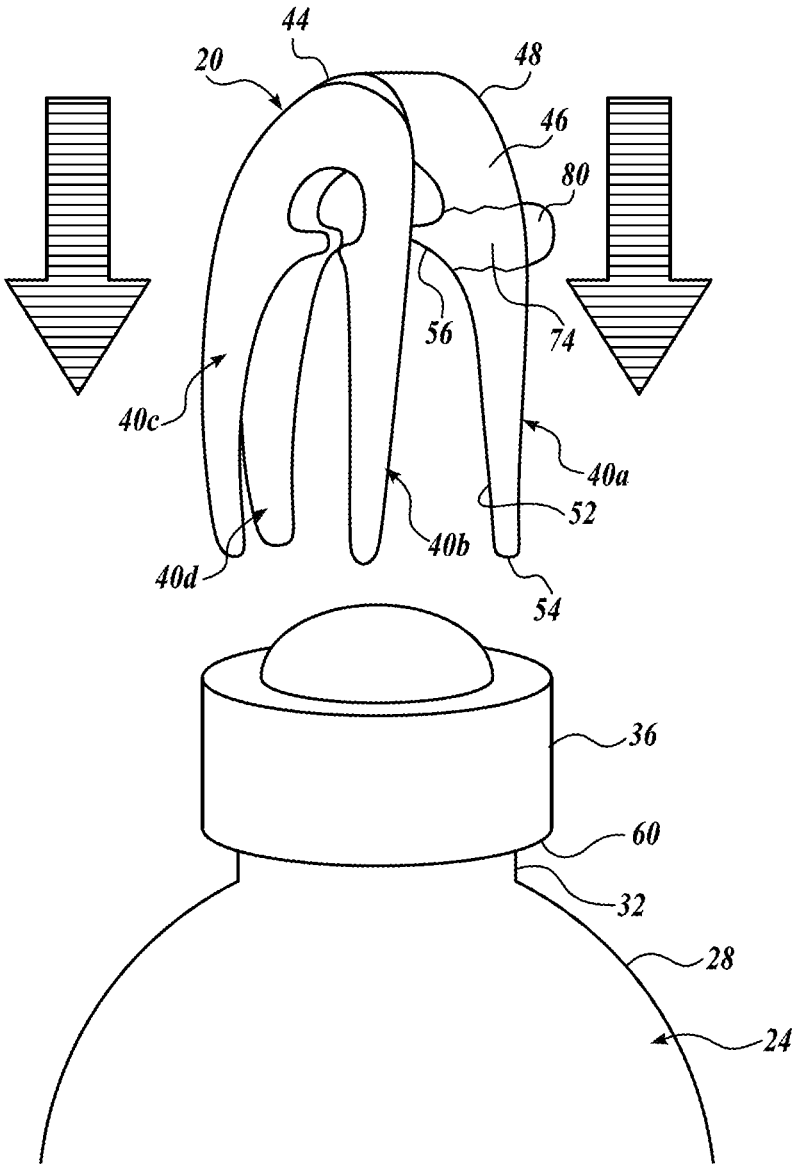
FIG. 1 is an isometric view of a cap protector formed in accordance with an exemplary embodiment of the present disclosure, wherein the cap protector is shown being moved from a disengaged position to an engaged position.
Figure 2:
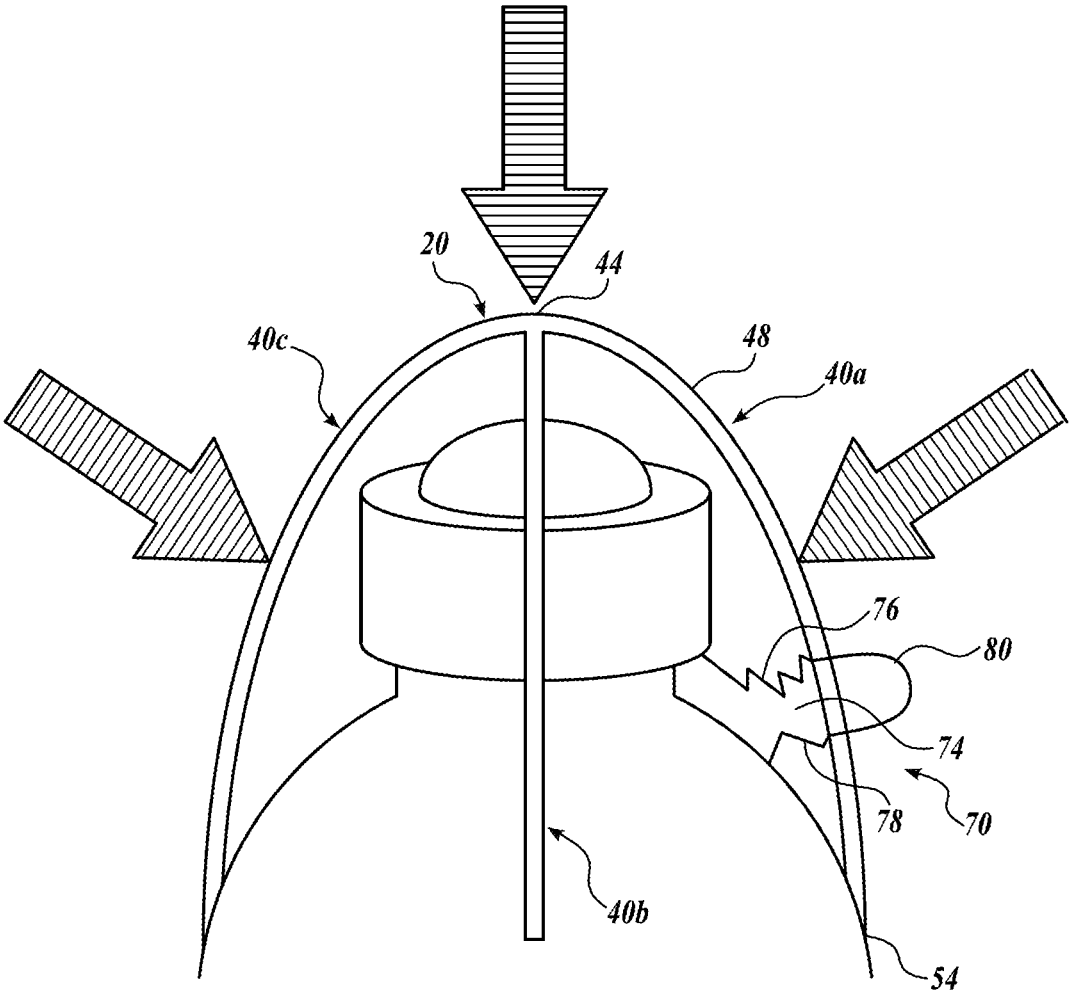
FIG. 2 is an isometric view of the cap protector of FIG. 1, wherein the cap protector is shown in an engaged position.
Figure 3:
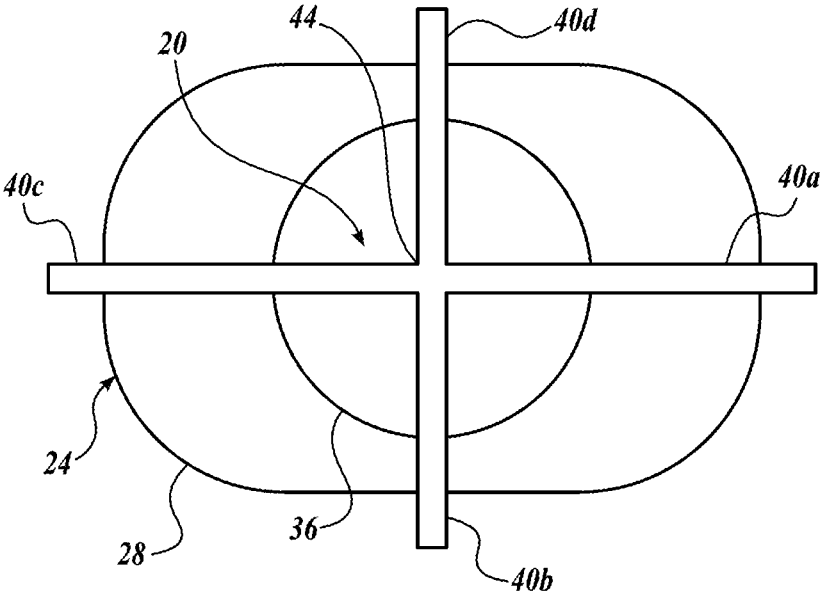
FIG. 3 is a top view of the cap protector of FIG. 1.

Referring to FIGS. 1-3, the cap protector 20 is shown in use with a container 24 having a container body 28 terminating at its upper end in a neck 32 that defines a container opening (not shown). A removable cap 36 (which may include a bottom carrier ring) is secured on the neck 32 by threading, snap-fit, etc., to enclose the opening. The neck 32 has a reduced diameter compared to the body 28. For instance, the body 28 may have a curved upper portion 30, somewhat dome-shaped, which terminates in the neck 32, as shown. In other embodiments, the body 28 may be substantially the same diameter and shape along its length, with a neck protruding from an upper flat end. It should be appreciated that the cap protector 20 may be configured for use with any suitable capped container.

The cap protector 20 is configured to be snap-fit over and onto the cap 36 for temporary protection of the cap. The cap protector 20 is generally of an open molded form having a plurality of axial fins extending downwardly from a top common center point 44. In the depicted embodiment, first, second, third, and fourth axial fins 40*a*, 40*b*, 40*c*, and 40*d* extend downwardly from the top center point 44. Each of the axial fins 40*a*, 40*b*, 40*c*, and 40*d* is spaced substantially circumferentially equidistant from the other fins, as shown in FIG. 3. It should be appreciated that more or less than four axial fins may instead be used.

Each of the axial fins 40*a*, 40*b*, 40*c*, and 40*d* is substantially identical; and therefore, only the first axial fin 40*a* will be described in detail. The first axial fin 40*a* has a body 46 that extends between an outer edge 48 and an inner edge 52. The body 46 has a radial width extending between the outer edge 48 and the inner edge 52 that is substantially greater than its thickness. Accordingly, the strength of the first axial fin 40*a* is sufficient to withstand significant radial and compressive loads without failure or deformation, but without adding significant bulk or weight to the cap protector 20.

As can be seen in FIG. 2, the outer edge 48 curves downwardly from the top center point 44 toward the container body 28 when the cap protector 20 is received on the cap 36. As such, the outer edges 48 of the axial fins 40*a*, 40*b*, 40*c*, and 40*d* collectively define an overall general dome shape when the cap protector 20 is secured on the cap 36. With the cap protector 20 being substantially dome-shaped when secured on the cap 36, the cap protector 20 does not include any abrupt edges or surfaces that are more susceptible to catching on other materials or being damaged from loads, etc. Moreover, the cap protector 20 will more generally blend in with the overall shape of the upper end of the container 24. It can be appreciated that other overall shapes may be used to compliment containers having other shapes and configurations.

Referring to FIGS. 1 and 2, the inner edge 52 of the first axial fin 40*a* curves downwardly from the top center point 44 toward the container body 28. In this manner, when the cap protector 20 is moved into axial engagement with the cap 36, the outer surface of the cap 36 travels along the path defined by the inner edge 52 until the cap 36 is fully received within the cap protector 20. In that regard, the inner edge 52 guides the cap 36 into the engagement position with the cap protector 20.

The inner and out edges 52 and 48 converge and terminate at a bottom tip 54 defined at a predetermined axial length of the first axial fin 40*a* such that the cap protector 20 effectively blends in with or otherwise defines an extension of the upper end of the container body 28. In that regard, any abrupt edge between the cap protector 20 and the container body 28 will be minimized. Of course, the first axial fin 40*a* may instead terminate in another manner to correspond to containers of different shapes and configurations.

A cap-engaging lip 56 defined along the inner edge 52 of the axial fin 40*a* extends radially inwardly a predetermined distance such that it is receivable beneath a lower edge or shoulder 60 of the cap 36 when the cap protector 20 is moved into axial engagement therewith. More specifically, when the cap protector 20 is moved downwardly into axial engagement with the cap 36, the cap-engaging lip 56 of each axial fin 40*a*-40*d* passes over and then underneath the shoulder 60 of the cap 36 to secure the cap protector 20 onto the cap 36.

In that regard, in one embodiment, the cap protector 20 is injection molded from a suitably elastic yet rigid material, such as a suitable plastic (such as plastics, polymers, resins, thermoplastic polymers, elastomers, co-elastomers, polymers, co-polymers, and blends or combinations thereof, etc., degradable or biodegradable plastics materials, oxo-biodegradable plastics, biobased polymers, etc., blends, co-polymers, and/or derivatives thereof). In that regard, each of the axial fins 40*a*, 40*b*, 40*c*, and 40*d* may move radially outwardly from an initial non-engaged position, as shown in FIG. 1, to a cap-engaging position, as shown in FIG. 2, upon application of a predetermined force. The elasticity of the axial fins allows the cap-engaging lip 56 of each axial fin 40*a*-40*d* to pass over and then underneath the shoulder 60 of the cap 36. In that regard, a snap-fit tactile sensation is provided to the user when the cap-engaging lip 56 engages the shoulder 60 of the cap 36. The snap-fit tactile sensation provides feedback to the user to indicate that the cap protector 20 is fully secured on the cap 36.

Moreover, due to the elastic nature of the cap protector 20, the axial fins 40*a*, 40*b*, 40*c*, and 40*d* exert a substantially radial force on the cap 36 to retain the cap protector 20 thereon in the cap-engaging position. At the same time, the cap protector 20 is retained axially on the cap 36 by the maintained interference of the cap lips 56 with the shoulder 60.

When received on the cap 36, the cap protector 20 helps prevent any significant damage to the cap 36 and/or the upper end of the container body 28 from logistical stresses. The axial fins 40*a*, 40*b*, 40*c*, and 40*d* of the cap protector absorb and/or transfer any compressive loads to the upper end of the container body 28.

When the logistics process has terminated and/or when the contained product is ready for use, the cap protector 20 may be removed from the cap 36. Although the cap protector 20 may be removed from the cap 20 in any suitable manner, in one embodiment, the cap protector 20 includes a removal assembly 70 configured for at least partially removing the first axial fin 40*a* and/or any of the other fins.

Figure 4:
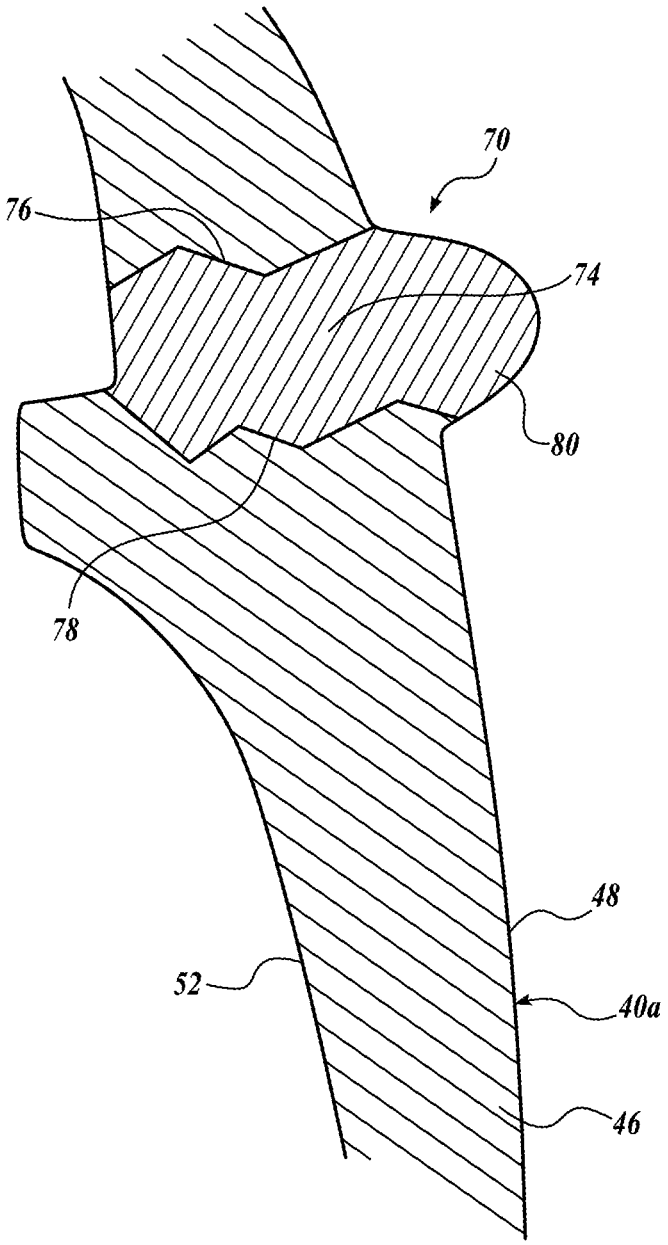
FIG. 4 is a detailed isometric view of a removal assembly of the cap protector of FIG. 1.
Figure 5:
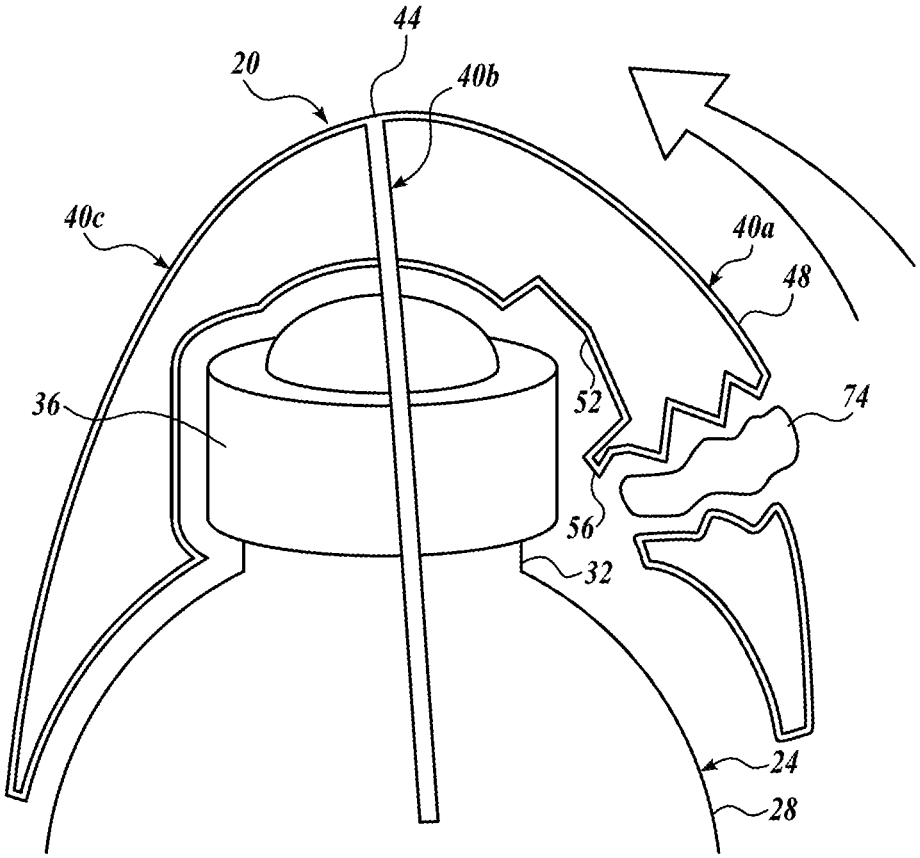
FIG. 5 is an isometric view of the cap protector of FIG. 1, wherein a portion of the cap protector has been removed through the removal assembly.

Referring to FIGS. 4 and 5, the removal assembly 70 is defined by a removable portion 74 that is partially scored, cut, notched, torn, bent, perforated, or otherwise tearable or cuttable from the first axial fin 40*a*. In one embodiment, the removable portion 74 is defined by first and second substantially parallel detachment lines 76 and 78 that extend substantially transversely across the body 46 of first axial fin 40*a*. When torn or cut across the detachment lines 76 and 78, the removable portion 74 may be removed from the first axial fin 40*a*. A tab portion 80 may extend laterally from the removable portion 74 that is graspable by a user to tear the removable portion 74 from the first axial fin 40*a*.

With the removable portion 74 removed from the first axial fin 40*a*, the portion of the first axial fin 40*a* beneath the removable portion 74 (towards the bottom tip 54) is separated from the cap protector 20. In another embodiment (not shown), only a single score, cut, notch, etc., extends across the body 46 of first axial fin 40*a* such that the removable portion is defined as the portion of the first axial fin 40*a* beneath the score, cut, notch, etc.

The score, cut, notch, etc., of the removable portion 74 may be located substantially at or above the cap-engaging lip 56. In this manner, the first axial fin 40*a* will become disengaged with, or will no longer interfere with the shoulder 60 of the cap 36 when the removable portion 74 is removed. As such, the cap protector 20 will only be retained on the cap 36 by the second, third, and fourth axial fins 40*b*, 40*c*, and 40*d*. Without all the axial fins equally exerting a retaining force on the cap 36, the cap protector 20 may be easily separated from the cap 36. Once removed from the cap 36, the contained product may be consumed or otherwise used in the intended manner. Moreover, the cap protector, made from plastic or another similar material, may be recycled once removed.

As can be appreciated from the foregoing, the cap protector 20 simplifies and improves the packaging and shipping process for capped containers. The upper capped end of the product can be protected with a single application step at the manufacturing or distribution center. Moreover, the cap protector 20 absorbs and/or redistributes any compressive forces imposed on the capped end during the logistical process, which is normally only possible with form or other expensive traditional packaging solutions.

With e-commerce at its height, simplification and improvement of the packaging and shipping process saves money for the supplier and ultimately the purchaser. Moreover, the purchaser receives a capped product that is undamaged and unopened, and the cap protector can be easily removed and recycled, preventing frustration and customer dissatisfaction.

The detailed description set forth above in connection with the appended drawings is intended as a description of exemplary embodiment of a cap protector, and is not intended to represent the only embodiment. The representative embodiment described in this disclosure is provided merely as an example or illustration and is not intended to be exhaustive or to limit the claimed subject matter to the precise forms disclosed.

In the foregoing description, numerous specific details are set forth in order to provide a thorough understanding of the exemplary embodiment of the present disclosure. It will be apparent to one skilled in the art, however, that the exemplary embodiment of the present disclosure may be practiced without some or all of the specific details. In some instances, well-known process steps or features have not been described in detail in order not to unnecessarily obscure various aspects of the present disclosure. Further, it will be appreciated that the exemplary embodiment of the present disclosure may employ any combination of features described herein.

The present disclosure may also include references to directions, such as "upper," "lower," "inner," "outer," "upward," "downward," "lateral," "medial," "vertical," "horizontal," "proximal," "distal," "central," etc. These references, and other similar references in the present disclosure, are only to assist in helping describe and understand the particular embodiment and are not intended to limit the present disclosure to these directions or locations.

The present disclosure may also reference quantities and numbers. Unless specifically stated, such quantities and numbers are not to be considered restrictive, but exemplary of the possible quantities or numbers associated with the present disclosure. Also in this regard, the present disclosure may use the term "plurality" to reference a quantity or number. In this regard, the term "plurality" is meant to be any number that is more than one, for example, two, three, four, five, etc. In an embodiment, "about," "approximately," etc., means plus or minus 5% of the stated value.

While embodiments of a cap protector have been illustrated and described, it will be appreciated that various changes can be made therein without departing from the spirit and scope of the present disclosure.

The invention claimed is:

1. A cap protector for protecting a cap on a container, comprising:

a plurality of axial fins extending radially outwardly from a common center point configured to be positioned on top of the cap, each axial fin of the plurality of axial fins comprising:

an elongate rigid body extending, in a radial direction relative to the common center point, between a radially inner edge and a radially outer edge, wherein the elongate rigid body extends away from the common center point to a bottom tip; and a cap-engaging lip formed along the radially inner edge and being configured to selectively engage and be received beneath a cap disposed on the container, wherein the cap-engaging lips of the plurality of axial fins are substantially co-planar, wherein the elongate rigid body has a radial width extending between the radially inner edge and the radially outer edge, wherein the radial width is greater than a thickness of the elongate rigid body.

2. The cap protector of claim 1, wherein for at least one axial fin of the plurality of axial fins, the radially inner edge and the radially outer edge converge at the bottom tip.

3. The cap protector of claim 1, wherein each axial fin of the plurality of axial fins is movable from a disengaged position to an engaged position, wherein in the engaged position, the container-engaging lip of each axial fin of the plurality of axial fins is configured to engage the container.

4. The cap protector of claim 3, wherein each axial fin of the plurality of axial fins is elastically deformable between the disengaged position and the engaged position.

5. The cap protector of claim 4, wherein elastic return of the axial fin from the disengaged position to the engaged position provides a snap fit onto the container.

6. The cap protector of claim 1, wherein the plurality of axial fins comprises at least three axial fins radially spaced about the common center point.

7. The cap protector of claim 1, wherein all axial fins of the plurality of axial fins are identical.

8. The cap protector of claim 1, wherein the cap-engaging lip extends radially inward from the radially inner edge.

9. The cap protector of claim 1, wherein at least one axial fin of the plurality of axial fins includes a removable portion configured for detachment from the axial fin, wherein the removable portion comprises the container-engaging lip.

10. The cap protector of claim 9, wherein the removable portion is configured for detachment from the axial fin at a detachment location.

11. The cap protector of claim 10, wherein the detachment location is at least one of scored, cut, notched, torn, bent, perforated, tearable, or cuttable.

12. The cap protector of claim 10, wherein the removable portion includes a tab extending radially away from the radially outer edge.

13. A system comprising the container, the cap, and the cap protector of claim 1, wherein the cap protector engages the container and is disposed over a top of the cap.

* * * * *